US005132498A

United States Patent [19]

Lee

[11] Patent Number: 5,132,498

[45] Date of Patent: Jul. 21, 1992

[54] STRUCTURE OF FOOT SWITCH

[76] Inventor: Don Lee, 6F, No. 473, Tun Hua S. Road, Taipei, Taiwan

[21] Appl. No.: 803,762

[22] Filed: Dec. 5, 1991

Related U.S. Application Data

[63] Continuation of Ser. No. 561,434, Aug. 1, 1990, abandoned.

[51] Int. Cl.[5] ..... H01H 13/56; H01H 3/14

[52] U.S. Cl. ..... 200/523; 200/573; 200/528; 200/86.5

[58] Field of Search ..... 200/523, 86.5, 573, 200/528, 533, 337, 332, 341

[56] References Cited

U.S. PATENT DOCUMENTS 3,502,833 4/1968 Rossini et al. ..... 200/86.5
3,867,591 2/1975 Nordeen ..... 200/86.5
4,434,340 2/1984 Kondo ..... 200/332
4,736,081 4/1988 Sorrells ..... 200/533

*Primary Examiner*—Ernest G. Cusick
*Assistant Examiner*—David J. Walczak
*Attorney, Agent, or Firm*—Lowe, Price, LeBlanc & Becker

[57] ABSTRACT

A foot switch comprising a base covered with an upper cover to hold a pressure-contact switch, a rotary type actuating member, a compression spring and a press member. The press member is supported by the compression spring to protrude beyond the center hole of the upper cover. Once the press member is pressed down, the pressure-contact switch is electrically connected by the operation of the acutating member, and the press member is forced by the compression spring to move back to original position after release of pressure force therefrom. Once the press member is pressed down again, the pressure-contact switch is electrically disconnected.

1 Claim, 2 Drawing Sheets

STRUCTURE OF FOOT SWITCH

This application is a continuation of application Ser. No. 07/561,434 filed Aug. 1, 1990 now abandoned.

BACKGROUND OF THE INVENTION

The present invention is related to foot switches, and more particularly to a foot switch which has a horizontal type of pressure-contact switch controlled by a rotary type of actuating member through a compression spring and a press member.

The conventional type of foot switch generally comprises a pressure-contact switch disposed in a vertical position and directly controlled by a pressure cap to connect or disconnect electricity. Because the pressure-contact switch is disposed in a vertical position, a foot switch is relatively shaped in a high and sharp configuration which does not fit the foot for comfortable press control and may be damaged easily.

SUMMARY OF THE INVENTION

The present invention has been accomplished under the circumstances in view. It is the main object of the present invention to provide a foot switch which is designed in a flat shape to fit the foot for comfortable operation and extend its service life.

BRIEF DESCRIPTION OF THE DRAWINGS

The present invention will now be described by way of example, with reference to the annexxed drawings, in which.

DETAILED DESCRIPTION OF THE PREFERRED EMBODIMENTS

Figure 1:
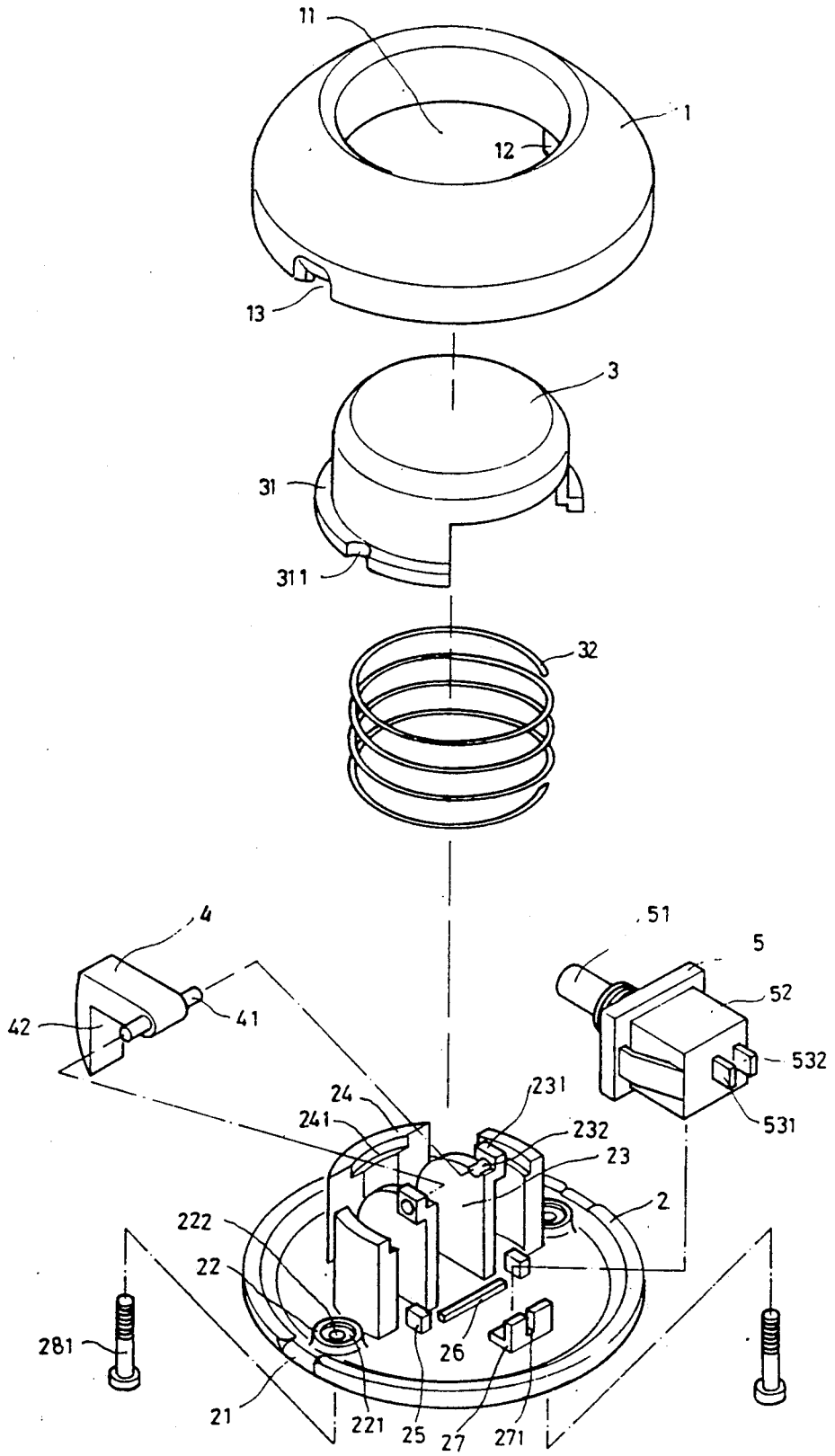
FIG. 1 is a perspective dismantled view of the preferred embodiment of the present invention.
Figure 2:
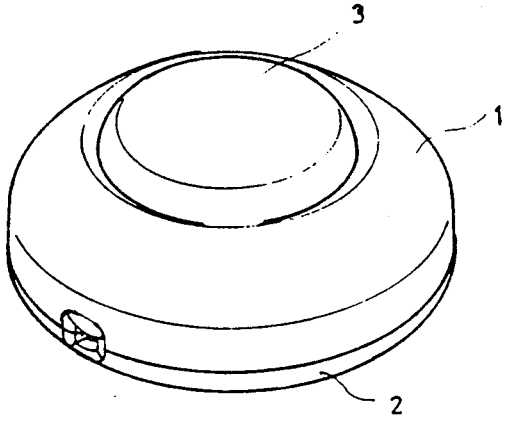
FIG. 2 illustrates the outer appearance of the preferred embodiment of the present invention.

Referring to the annexed drawings in greater detail, therein illustrated is a foot swtich embodying the present invention and generally comprised of an upper cover 1, a base 2, a press member 3, an actuating member 4 and a pressure-contact switch 5. The upper cover 1 is designed in round shape, having a domed top defining therein a center hole 11 at the center, two cylindrical projections 12 which have each a bolt hole (not shown) on the bottom extending downward therefrom at the bottom at two opposite sides, and two opposite notches 13 on the bottom edge. The base 2 is shaped like a round dish having a raised periphery with two opposite notches 21 made thereon and designed in size and locations corresponding to the two opposite notches 13 on the bottom edge of the upper cover 1. Two raised circular portions 22 are made on the base 2 at two opposite sides and respectively close to the two notches 21. Each raised circular portion 22 defines therein a recess 221 with a bolt hole 222 made at the center. There are two parallel sector boards 23 upstanding from the base 2 and having each an unitary projecting strip 231 at an outer side at the top with a round hole 232 made thereon. A plurality of unitary plates 24 in circular arc are made on the base 2 around a semi-circle surrounding the two parallel sector boards 23, which have each a recessed portion 241 at its top at the inner side. There are two opposite square blocks 25, an elongated strip 26 and a L-shaped plate 27 made on the base 2 at the front of the two parallel sector boards 23 and forming a switch stand, in which the L-shaped plate 27 has a notch 271 at the middle. The press member 3 is a short, cylindrical covering having a circular top surface and a bottom flange 31 for holding a compression spring 32 therein, which bottom flange 31 comprises two side notches 311 at two opposite sides. The actuating member 4 is an angle plate having a hooked portion 42 formed at one end and two opposite dowels 41 bilaterally made at an opposite end. The pressure-contact switch 5 has a cylindrical press button 51 at the top, a square body 52 at the middle and two conductive strips 531, 532 at the bottom.

The process to assemble the afore-said parts into a foot switch is outlined hereinafter. The square body 52 of the pressure-contact switch 5 is mounted on the switch stand of the square blocks 25, the elongated strip 26 and a L-shaped plate 27 permitting the conductive strip 531 inserted through the notch 271 on the L-shaped plate 27 and permitting the biased cylindrical press button 51 to insert in the space between the two parallel sector boards 23. The two dowels 41 of the actuating member 4 are then inserted in the round holes 232 of the two parallel sector boards 23 permitting the hooked portion 452 to insert in the space therebetween and stop against the cylindrical press button 51 of the pressure-contact switch 5. After the compression spring 32 is mounted on the unitary plates 24 at the recessed portions 241 thereof, the press member 3 and the upper cover 1 are respectively mounted on the base to cover the compression spring 32, permitting the two cylindrical projections 12 of the upper cover 1 to respectively be inserted in the two side notches 311 of the press member 3 to prohibit the press member 3 from rotation relative to the upper cover 1, and permitting the press member 3 to protrude beyond the center hole 11 of the upper cover 1 with its bottom flange 31 stopped at the bottom edge of the upper cover 1. Then, screw means 281 are used to respectively fastened through the bolt holes 222 of the base 2 in the cylindrical projections 12 of the upper cover 1 to fixedly secure the upper cover 1 to the base. After assembly, the two notches 13 of the upper cover 1 and the two notches 21 of the base 2 are respectively incorporated together to form into two square holes at two opposite sides for insertion of electric wires.

The operation of the afore-said preferred embodiment of the present invention is outlined hereinafter. Once the press member 3 is pressed down, the actuating member 4 is forced by the press member 3 to rotate downward permitting the hooked portion 42 to press on the cylindrical press button 51 so as to electrically connect the two conductive strips 531, 532. As soon as pressure force is released from the press member 3, the compression spring 32 automatically pushes the press member 3 back to original position. When an outer force is secondarily applied to press on the press member 3, the cylindrical press button 51 is squeezed again to electrically disconnect the conductive strips 531, 352.

I claim:

1. A foot switch comprising:

a base, a pair of mutually spaced sector boards centrally located on and upstanding from said base and upstanding spaced plates mounted on said base and surrounding a portion of said sector boards; an actuating member pivotally mounted on said sector boards on the upper portions thereof distal to said base said actuating member having a depending hook extending downwardly between said sector boards;

a normally open pressure contact switch means mounted on said base adjacent said sector boards and including a biased cylindrical press button extending outwardly therefrom between said sector boards and abutting an inner surface of said hook for closing and opening an electrical circuit responsive to movement of said button;

a dome-like cover mounted on said base and extending upwardly to surround said sector boards, actuating member and switch means, said cover having a central opening over said actuating member and sector boards;

a cap member slidably mounted in the opening of said cover and bias means coupled between said spaced plates and cap means for normally urging said cap upwardly so that when said cap member is depressed causing said actuating member to pivot, depressing said biased button to close a circuit said cap will be urged upwardly by said bias means releasing said button to urge said acutating member into opposite pivotal movement to open a circuit.

* * * * *